United States Patent [19]

Miyano et al.

[11] Patent Number: 4,598,682

[45] Date of Patent: Jul. 8, 1986

[54] METHOD OF CONTROLLING AIR-FUEL RATIO OF AN ENGINE

[75] Inventors: Takashi Miyano, Kanagawa, Japan

[73] Assignee: Mikuni Kogyo Kabushiki Kaisha, Tokyo, Japan

[21] Appl. No.: 667,885

[22] Filed: Nov. 2, 1984

[51] Int. Cl.[4] ..... F02B 3/00

[52] U.S. Cl. ..... 123/440

[58] Field of Search ..... 123/440, 489

[56] References Cited

U.S. PATENT DOCUMENTS

| | | | |
|---|---|---|---|
| 4,111,171 | 9/1978 | Aono | 123/440 |
| 4,122,811 | 10/1978 | Bowler | 123/440 |
| 4,224,910 | 9/1980 | O'Brien | 123/440 |
| 4,235,204 | 11/1980 | Rice | 123/440 |
| 4,307,694 | 12/1981 | Jacobs | 123/489 |
| 4,391,250 | 7/1983 | Matsui | 123/440 |
| 4,397,278 | 8/1983 | Hughes | 123/440 |

*Primary Examiner*—Ronald B. Cox

*Attorney, Agent, or Firm*—Owen, Wickersham & Erickson

[57] ABSTRACT

A method of controlling air-fuel ratio of an internal combustion engine is disclosed. An oxygen sensor is mounted to the engine to detect oxygen concentration in the exhaust gas from the engine and generate a voltage signal therefrom. The air-fuel is a controlled ratio in accordance with the detected result. The oxygen concentration is sampled in synchronism with the rotational speed of the engine, and sampled results are stored as a correction factor by taking the engine rotational speed into account. The air-fuel ratio is controlled by correction factor previously stored in the preceding sampling time of a given sampling time when a change of the air-fuel ratio is detected by comparing its voltage signal with a reference voltage of the oxygen sensor.

5 Claims, 5 Drawing Figures

METHOD OF CONTROLLING AIR-FUEL RATIO OF AN ENGINE

BACKGROUND OF THE INVENTION

The present invention relates to a method for controlling the air-fuel ratio of an internal combustion engine, and more particularly to a method for controlling the air-fuel ratio of an engine capable of optimum control without the waste of time heretofore inherent with the use of an oxygen sensor.

In controlling the air-fuel ratio of the engine, generally, an oxygen sensor (hereinafter referred to as an $O_2$ sensor) is used as a gas sensor. This $O_2$ sensor is attached to an internal combustion engine so as to detect the oxygen concentration in the exhaust gas from the engine and thereby control the air-fuel ratio. The output of the $O_2$ sensor is detected by the oxygen concentration in the exhaust gas. It is well known that there is a time deviation or delay between the air-fuel ratio or mixture at an instant of taking the mixture into the engine and the air-fuel ratio at an instant detected by the $O_2$ sensor after burning the mixture in the engine cylinder. FIG. 1 shows an excess air ratio $\lambda$ and a transient response of the $O_2$ sensor. FIG. 1 shows a condition wherein the excess air ratio $\lambda$ is changed in step fashion between 0.9 and 1.1. $T_S$ is a delay time of the system previously determined by the engine, that is, a time required for the fuel to reach the $O_2$ sensor after being burned in the engine cylinder when the excess air ratio $\lambda$ is changed between $\lambda=1.1$ (lean air-fuel ratio) and $\lambda=0.9$ (rich air-fuel ratio). $T_R$ and $T_L$ are time delays of the $O_2$ sensor itself when the air-fuel ratio is changed from the lean condition to the rich condition and from the rich condition to the lean condition, respectively. The conventional method of controlling the air-fuel ratio, taking these time delays into consideration, is illustrated in FIGS. 2*a* and 2*b*. That is, FIG. 2*a* shows a relation between the change relative to time of the air-fuel ratio and a comparison voltage of the $O_2$ sensor. FIG. 2*b* shows a relation between the excess air ratio $\lambda$ and the controlled output of the device relative to time. It has been found that FIGS. 2*a* and 2*b* correspond as to time with each other. As seen from FIG. 2*a*, when the output of the $O_2$ sensor is changed in turn from a lean to a rich condition (at $X_1$) and a rich to a lean condition (at $X_2$) the performance curve of the air-fuel ratio is intersected each time by the comparison reference voltage level (0.5 V) formed by the $O_2$ sensor. As shown in FIG. 2*b*, when control of the sensor output, shown by a solid line, operates toward or to the lean in the case of rich condition of air-fuel ratio, and toward or to the rich condition in the case of lean condition of air-fuel ratio, a time delay or control deviation in time is generated. At the intersection of the sensor output with the comparison voltage 0.5 (at the inversion), a step gain shown by a dotted line is added to an integrating gain (solid line in FIG. 2*b*), thereby resulting in an adjustment of control amount with a time correction. That is, the amplitude of oscillatory control is controlled.

In the above conventional method, however, when output of the $O_2$ sensor is frequently intersected with the comparison voltage of 0.5 V, i.e., when the air-fuel ratio is frequently changed, each time the step gain shown by the dotted line is added, stable control cannot be obtained, and the wasted time cannot be eliminated.

SUMMARY OF THE INVENTION

It is an object of the present invention to resolve the above problems of the conventional method of controlling the air-fuel ratio of the engine.

It is another object of the present invention to provide a method of controlling the air-fuel ratio of an internal combustion engine according to the present invention, in which an oxygen sensor capable of optimum control is utilized to eliminate wasted time.

The present invention controls the air-fuel ratio of an internal combustion engine by apparatus comprising an oxygen sensor mounted on or attached to the engine, means for detecting the oxygen concentration in the exhaust gas from the engine utilizing the oxygen sensor, means for controlling the air-fuel ratio in accordance with the detected result, means for sampling the oxygen concentration in synchronism with the rotational speed of the engine, means for storing sampled results as a correction factor by taking the engine rotational speed into account, and means for controlling the air-fuel ratio by a correction factor previously stored in the latest preceding sampling time, when a change of the air-fuel ratio was detected, as compared with a reference voltage of the oxygen sensor.

Detection of a change in the air-fuel ratio occurs when a sampled result at the current sampling time and a sampled result at a preceding sampling represents a difference in the air-fuel ratio. Memory contents stored over a given sampling time provides a sampled result whenever both sampled results at the current sampling time and the sampled results at a preceding sampling time are in the rich condition. Memory contents stored over a given sampling time also provide a sampled result whenever both sampled results at the current sampling time and the sampled results at a preceding sampling time are in a lean condition.

These and other features and advantages of the present invention will become readily apparent from the following detailed description of one embodiment of the present invention, particularly when taken in connection with the accompanying drawings.

DETAILED DESCRIPTION OF EMBODIMENT

Figure 1:
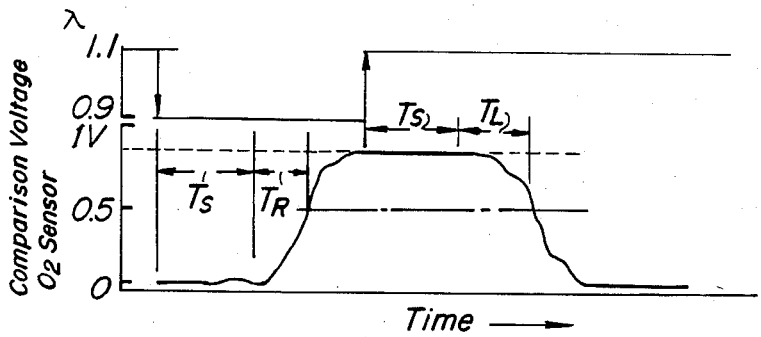
FIG. 1 is a characteristic graph showing a relation between the excess air ratio and the transient response of an oxygen sensor.
Figure 2A:
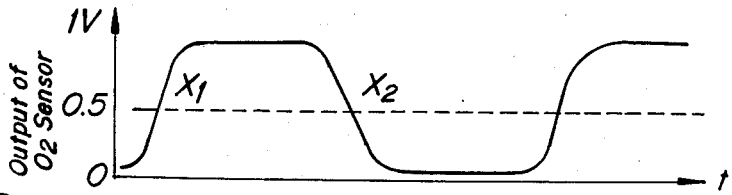
FIG. 2*a* is a waveform graph showing a relation between the change of air-fuel ratio and a reference comparison voltage of the $O_2$ sensor relative to time.
Figure 2B:
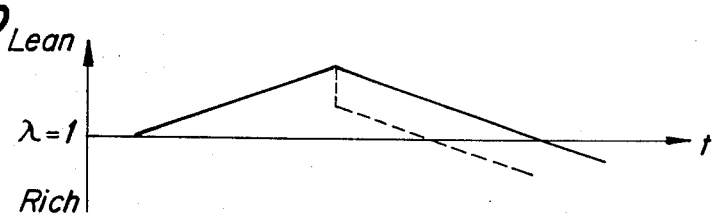
FIG. 2*b* is a graph showing the relation between the excess air ratio $\lambda$ and the controlled output of the device relative to time.

Referring to the drawing, there is shown an embodiment of a system for controlling the air-fuel ratio of an internal combustion engine according to the present invention.

Figure 3:
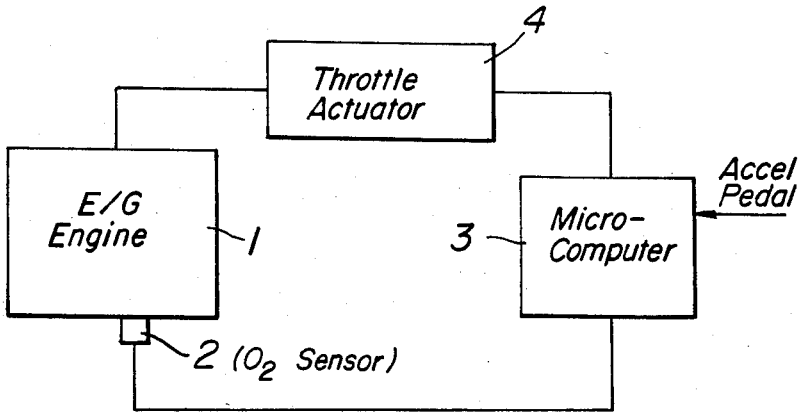
FIG. 3 is a block diagram of one embodiment of the device of the present invention for carrying out a Rand method for controlling the air-fuel ratio of an internal combustion engine according to the present invention.

FIG. 3 shows an apparatus for carrying out the method of controlling the air-fuel ratio of an internal combustion engine with the use of an oxygen sensor, according to the present invention.

In FIG. 3, an internal combustion engine 1 is provided with an oxygen sensor 2 at its exhaust pipe. The oxygen sensor ($O_2$ sensor) 2 detects the oxygen concentration in the exhaust gas from the engine 1 and generates an electric signal corresponding to the oxygen concentration. A microcomputer 3 receives the electric signal and arithmetically manipulates the signal. The output of the microcomputer 3 is supplied to a throttle actuator 4, thereby controlling the engine 1.

The apparatus shown in FIG. 3 operates as follows: As explained previously, it takes a certain time $T_S$ until the fuel supplied to a cylinder of the engine 1 and having a given air-fuel ratio reaches the exhaust pipe after being burnt in the engine cylinder. This time lag or delay $T_S$ is referred to as waste time and has a value which is proportional to the engine cycle. Thus, in order to perform optimum control, it is necessary to use both the current sampling instant of oxygen concentration (air-fuel ratio) as determined by the $O_2$ sensor 2, and the sampled value of the oxygen concentration taken at a time before the current sampling times when the oxygen concentration last crossed a reference comparison voltage of the $O_2$ sensor from a lean-to-rich condition or from a rich-to-lean condition. In this case, the control content is decided not only on the basis of the crossing direction at the current instant, but also by taking the air-fuel ratio condition at a time preceding the sampling instant. For the step gain, the optimum control is performed by a throttle actuator 4 with the use of a correction factor of air-fuel ratio before a previously set waste time when the output of the $O_2$ sensor 2 is changed from a rich-to-lean condition, and from a lean-to-rich condition.

Figure 4:
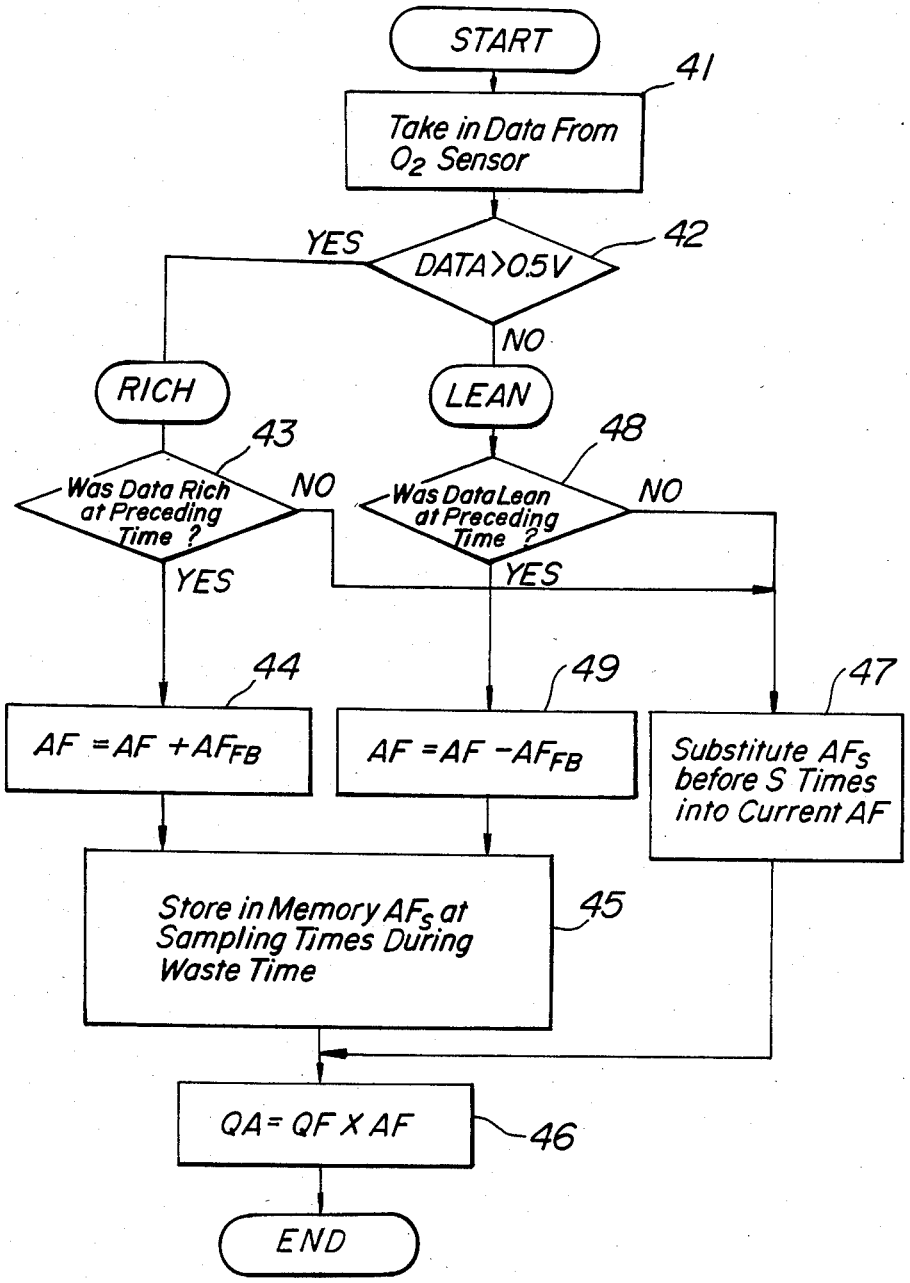
FIG. 4 is a flow chart explaining the operating steps of the microcomputer shown in FIG. 3.

The operation of the microcomputer 3 may be described with reference to FIG. 4. A start point is selected that is in synchronism with a rotational speed of the engine 1. At first, a step or block 41 receives sampling data from the $O_2$ sensor 2, which is provided at the exhaust pipe of the engine 1. A step 42 decides whether or not the received data exceeds or is less than a reference comparison voltage, e.g. of 0.5 V, as a criterion for the $O_2$ sensor 2.

When the step 42 decides that the rich condition (YES) exists, a step 43 decides whether or not the data was rich at the most recent preceding sampling instant at which there was a change from rich to lean or lean to rich. When the step 43 decides that the rich condition did exist at the end of that preceding instant, a step 44 updates the correction factor AF by calculating $AF = AF + AF_{FB}$ at every rotation of the engine, and then the updated correction factors AF are stored in a memory at a step 45 and corresponding to the sampling times during the waste time $T_S$ (S sampling times) until a next lean condition is decided. Then an air amount ($Q_A$) is calculated at a step 46 using the correction factor AF which was taken before the beginning of the waste time from the rotational speed of the engine at the decision as a lean condition, that is, before S sampling times retroactive to the sampling time corresponding to the waste time period of the engine system.

When the latest preceding sampling involving a change at the step 43 was not to a rich condition (NO), step 47 is employed. In this case, when the step 42 detects a rich condition as a change from a lean condition at the latest preceding sampling involving a change, this indicates that the $O_2$ sensor 2 has detected a change of the air-fuel ratio from a lean to a rich condition. Then, the step 46 calculates an air amount QA by using the correction factor $AF_S$ at S preceding a sampling which was previously stored in the step 45 by taking waste time into consideration, and the correction factor $AF_S$ of the preceding sampling is substituted at a step 47.

When the step 42 detects a lean condition (NO), a step 48 decides whether or not the result at the preceding sampling involving a change was a lean condition. In this case, when the current sampling result is a lean condition and the preceding result also ended in a lean condition, a step 49 corrects the factor AF resulting in $AF - AF_{FB}$, and this corrected factor is stored in the step 45, as was the corrected factor from the step 44. When the step 48 detects that the preceding sampling result after a change, result was not a lean condition, the status that the preceding sampling result was a rich condition and the current sampling result is a lean condition can be detected. In this case, the step 46 calculates the air amount QA with reference to the correction factor $AF_S$ at S, the preceding sampling at the step 47.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

What is claimed is:

1. A method of controlling the air-fuel ratio in an internal combustion engine having an oxygen sensor mounted on the engine at the exhaust, wherein the concentration of oxygen in the exhaust gases from the engine is sampled and detected by the oxygen sensor in synchronism with the rotational speed of the engine to obtain an electrical voltage signal corresponding thereto, thereafter controlling the air-fuel ratio in accordance with the detected result in the case of detecting a change in the air-fuel ratio, the method comprising the steps of:

taking a series of sample results from the oxygen sensor in synchronism with the rotational speed of the engine, comparing each latest sampled result with the sampled result at the preceding sampling time, calculating a correction factor of an integral gain at every rotation of the engine when the sampled result at current sampling time and the sampled result at the preceding sampling time are equal to each other, storing respective correction factors thus calculated retroactive to the sampling times corresponding to a waste time period of an engine system, applying the correction factor of the integral gain from the storing step when the sampled result at current sampling time and the sampled result at the preceding sampling time are not equal to each other, calculating an air amount by directly using the applied correction factor, and sending air to the engine in accordance with the newly calculated air amount.

2. A method of controlling the air-fuel ratio of an internal combustion engine as claimed in claim 1, wherein detection of change in the air-fuel ratio shows that the sampled result at current sampling time and the sampled result at said preceding sampling time are different in the air-fuel ratio.

3. A method of controlling the air-fuel ratio of an internal combustion engine as claimed in claim 1, wherein said comparing shows that both the sampled result at the current sampling time and the sampled result at said preceding sampling time are in rich condition.

4. A method of controlling the air-fuel ratio of an internal combustion engine as claimed in claim 1, wherein said comparing step shows that both the sampled result at the current sampling time and the sampled result at the preceding sampling time are in lean condition.

5. As apparatus for controlling the air-fuel ratio in an internal combustion engine having an oxygen sensor mounted on the engine at the exhaust, wherein the concentration of oxygen in the exhaust gases from the engine is sampled and detected by the oxygen sensor in synchronism with the rotational speed of the engine to obtain an electrical voltage signal corresponding thereto, thereafter controlling the air-fuel ratio in accordance with the detected result in the case of detecting a change in the air-fuel ratio, the improvement comprising:

means for taking a series of sample results from the oxygen sensor in synchronism with the rotational speed of the engine, means for comparing each latest sampled results with the sampled result at the preceding sampling time, means for calculating a correction factor of an integral gain at every rotation of the engine when the sampled result at correct sampling time and the sampled result at the preceding sampling time are equal to each other, means for storing respective correction factors thus calculated retroactive to the sampling times corresponding to a waste time period of an engine system, means for applying the correction factor of the integral gain from the storing step when the sampled result at current sampling time and the sample result at the preceding sampling time are not equal to each other, means for caculating an air amount by directly using the applied correction factor, and means for sending air to the engine in accordance with the newly caculated air amount.

* * * * *